US008701577B2

(12) United States Patent
Tseng

(10) Patent No.: US 8,701,577 B2
(45) Date of Patent: Apr. 22, 2014

(54) SEWING MACHINE WITH AN ADJUSTING STRUCTURE CAPABLE OF CONTROLLING A SWING CENTER OF A SWING ARM

(76) Inventor: Hsien-Chang Tseng, Taichung (TW)

( * ) Notice: Subject to any disclaimer, the term of this patent is extended or adjusted under 35 U.S.C. 154(b) by 597 days.

(21) Appl. No.: 13/029,193

(22) Filed: Feb. 17, 2011

(65) Prior Publication Data

US 2012/0210923 A1 Aug. 23, 2012

(51) Int. Cl.
*D05B 3/02* (2006.01)

(52) U.S. Cl.
USPC ..... 112/65; 112/446; 112/235

(58) Field of Classification Search
USPC ..... 112/157, 446, 448, 284, 220, 235–240, 112/65, 67, 73, 443, 475.25
See application file for complete search history.

(56) References Cited

U.S. PATENT DOCUMENTS

| | | | | |
|---|---|---|---|---|
| 2,746,750 | A * | 5/1956 | Hacklander | 112/322 |
| 2,905,120 | A * | 9/1959 | Hacklander | 112/320 |
| 3,200,780 | A * | 8/1965 | Eriksson | 112/444 |
| 6,382,118 | B1 * | 5/2002 | Wolf | 112/239 |
| 6,712,015 | B1 * | 3/2004 | Chen | 112/302 |

* cited by examiner

*Primary Examiner* — Danny Worrell

(57) ABSTRACT

A sewing machine with an adjusting structure capable of controlling a swing center of a swing arm includes an adjusting apparatus and corresponding structures cooperating with the adjusting apparatus. The adjusting apparatus is provided on the pivotal portion with a sliding groove and a sliding block that can horizontally slide with respect to each other. Between the sliding groove and the sliding block are further provided an adjusting bolt and an elastic element. By rotating the adjusting bolt, the relative position between the swinging center around which the whole swing arm pivots and the whole structure of the swing arm can be changed in the horizontal direction accurately and conveniently, thus assuredly adjusting the start point of the travel of the presser foot, achieving the objective of accursedly adjusting position of the travel sensing apparatus.

14 Claims, 10 Drawing Sheets

SEWING MACHINE WITH AN ADJUSTING STRUCTURE CAPABLE OF CONTROLLING A SWING CENTER OF A SWING ARM

BACKGROUND OF THE INVENTION

1. Field of the Invention

The present invention relates to a sewing machine, and more particularly to a sewing machine with an adjusting structure capable of controlling a swing center of a swing arm.

2. Description of the Prior Art

In the existing sewing machines, there are many mechanisms used to convert circular motion into linear reciprocating motion, therefore, the control of the travel of the presser feet has great influence on sewing quality. Different presser feet are designed to meet different sewing needs, which require the presser foot to have different travels, for example: when buttons are sewed, the presser foot should be specially designed in such a manner that one end of the presser foot is fixed on one end of the presser foot shaft, and the structure of the presser foot which presses the cloth can move along with the cloth. The corresponding total travel of the presser foot, as shown in FIG. 1, includes a first travel X1 starting from a start point X11 and ending at an end point X12 along the long side of the button hole, a second travel Y1 in the horizontal direction starting from a start point Y12 and ending at an end point Y22, a third travel X2 starting at a start point X21 and ending at an end point X 22, and a fourth travel Y2 starting at a start point Y21 and ending at an end point Y22. When the presser foot is located at the start point X11 of the first travel X1, the first sensing electrode of the travel sensor in the sewing machine will be turned on to make the sewing machine sew the long side of the button hole which starts from the start point X11 and ends at the end point of the first travel X1. After moving to a position where the second sensing electrode is turned on, the presser foot will start moving horizontally along with the cloth from the start point Y21 of the fourth travel Y2 to the end point Y22 and then directly turns to the start point X21 of the third travel X2 for performing the sewing operation along the third travel X2 and finally turns to the start point Y21 of the fourth travel Y2 for performing the sewing operation along the fourth travel until reaching the start point X11 of the first travel X1.

After the sewing machine is used for a period of time, some parts will become loose, hence, the positions where first and the second sensing electrodes are turned on are often different from the correct positions of the presser foot, which will produce a defective button hole, for example, as shown in FIG. 1-1, the two long sides of the button hole are different in length.

To solve the above problem, the positions where the first and the sensing electrodes of the travel sensing apparatus are turned on and the positions of the presser foot are designed to be adjusted, so that the start point of the respective travels of the presser foot can be controlled. However, since the corresponding adjusting structure is in the form of a cam, in the principle of mechanical designing, it is known that the cam may normally lead to non-single-direction displacement during the adjustment, in other words, when the displacement in the horizontal direction is needed to be adjusted, the displacement in the horizontal direction will be caused synchronously, thus leading to unneeded displacement, so that the travel of the presser foot is thus quite uncertain.

The present invention has arisen to mitigate and/or obviate the afore-described disadvantages.

SUMMARY OF THE INVENTION

The primary objective of the present invention is to provide sewing machine with an adjusting structure capable of controlling a swing center of a swing arm, which utilizes the adjusting apparatus disposed on the swing arm and the pivot shaft which is the swinging center as well as the adjusting bolt of the adjusting apparatus and the elastic element that are disposed between the respective elements to horizontally adjust the relative position and the relation of the whole structure of the swing arm except the swinging center namely the pivot shaft, and immediately position the elements after adjustment. By such arrangements, the swing arm can be accurately brought into contact with the sensing portions of the travel sensing apparatus without complicated adjustment.

The secondary objective of the present invention is to provide a sewing machine with an adjusting structure capable of controlling a swing center of a swing arm, which utilizes the elastic element and the adjusting bolt disposed between the swing arm and the adjusting apparatus to maintain the relevant elements in the optimal elastic prestress state, namely in the optimal pressing state, thus achieving the objective of maintaining the whole structure in the optimal stable state.

The third objective of the present invention is to provide a sewing machine with an adjusting structure capable of controlling a swing center of a swing arm in which the adjusting apparatus is directly mounted on the swing arm and the pivot shaft without any complicated structure or cam, so the assembly of the whole structure is simple, convenient and quick.

BRIEF DESCRIPTION OF THE DRAWINGS

FIG. 1-1 is a schematic view showing that the start and end points of the travel for swing the button hole have error;

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
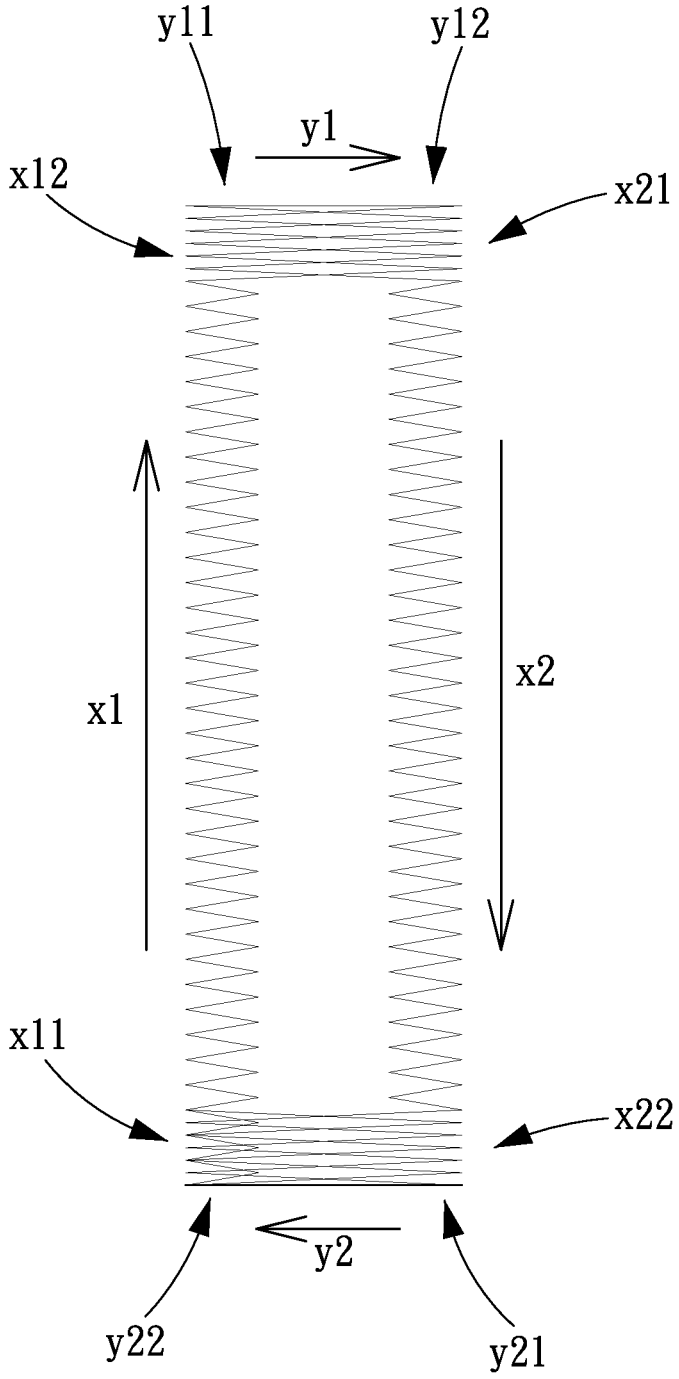
FIG. 1 PRIOR ART
FIG. 1 is a schematic view of a conventional travel for sewing a button hole
Figure 1:
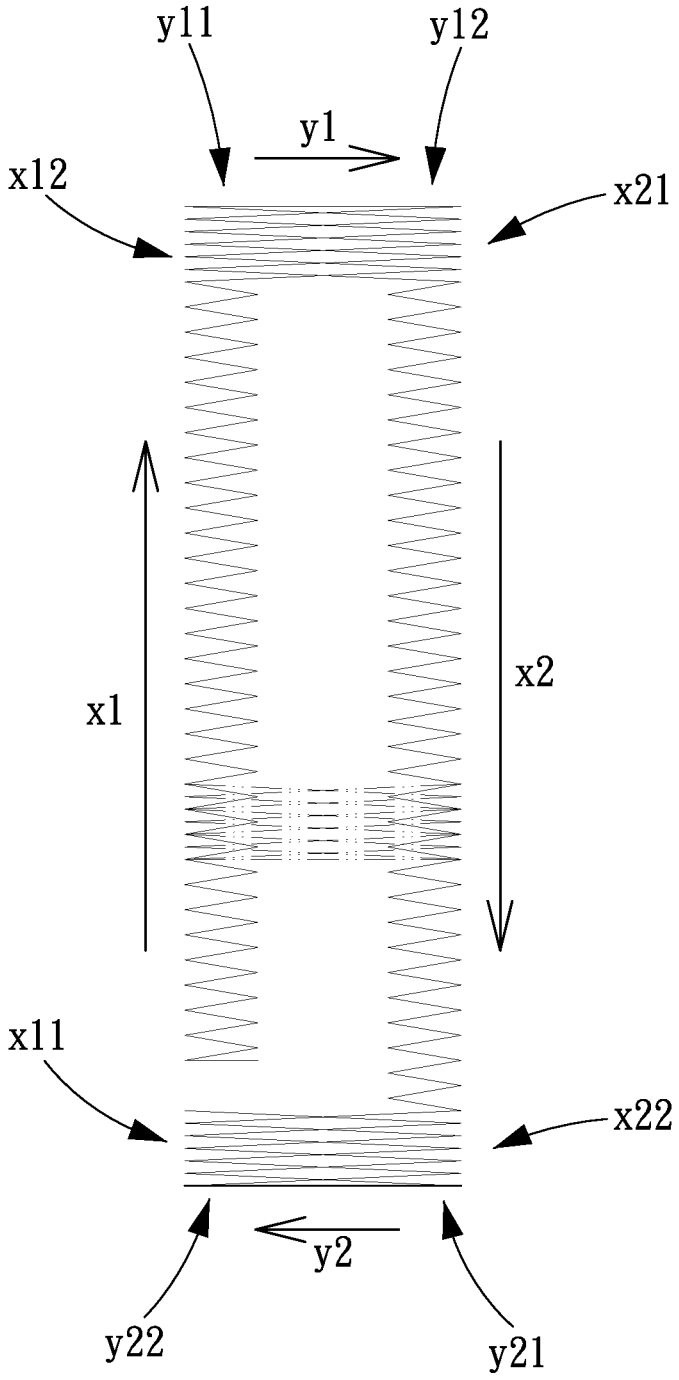
FIG. 1-1 PRIOR ART
Figure 2:
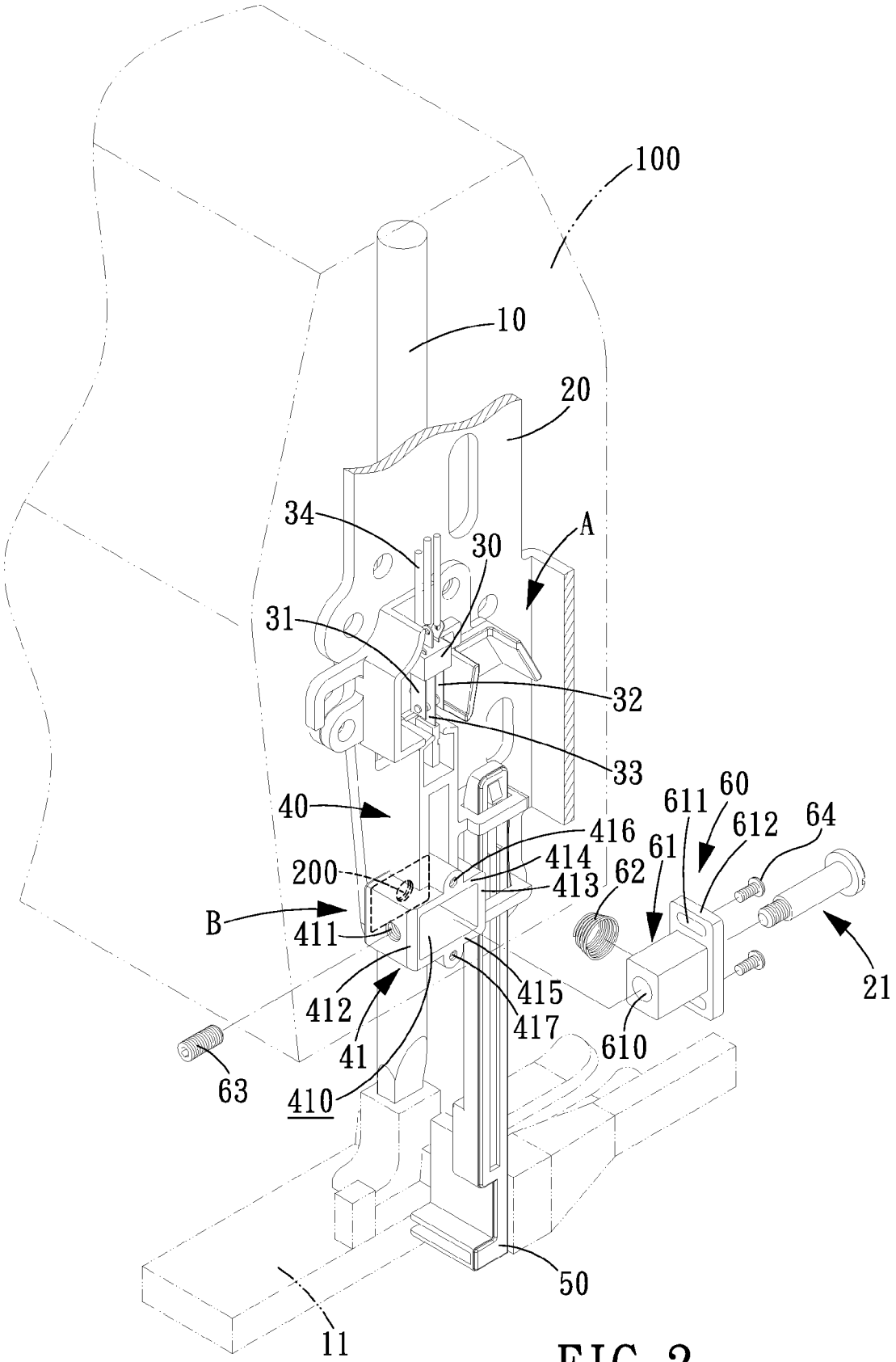
FIG. 2 is a partial exploded view of sewing machine with an adjusting structure capable of controlling a swing center of a swing arm in accordance with a first embodiment of the present invention.

Referring to FIG. 2 showing a sewing machine with an adjusting structure capable of controlling a swing center of a swing arm in accordance with a first embodiment of the present invention, the sewing machine includes a suspension arm 100 which is provided at a free end thereof with a presser foot shaft 10 and a fixing rack 20 adjacent to the presser foot shaft 10. The fixing rack 20 is formed by bending a plate-shaped element and provided with a travel sensing apparatus A in the suspension arm 100. The travel sensing apparatus A includes a sensor 30, and a swing arm assembly B which is moved by a presser foot 11 disposed at a bottom of the presser foot shaft 10. The swing arm assembly B includes a main body 40 for turning on/off the sensor 30, and a sliding element 50 which is vertically and movably inserted in the main body 40. A first end of the sliding element 50 is inserted in a bottom end of the main body 40 while a second end of the sliding element 50 protrudes toward the presser foot 11 to a height where the sliding element 50 can be moved by the presser foot 11 when the presser foot 11 horizontally moves to the start and end points of the travel. Since such structures are conventional, no further explanations are provided herein.

The sensor 30 includes a first sensing portion 31, a second sensing portion 32 and a movable induction portion 33 disposed between the first and the second sensing portions 31. The first sensing portion 31, the second sensing portion 32 and the induction portion 33 are in the form of a metal sheet electrode. Each of the first sensing portion 31, the second sensing portion 32 and the induction portion 33 is connected to a computer through a wire 34. The induction portion 33 can be moved by the main body 40 of the swing arm assembly B in such a manner that the induction portion 33 can move toward any one of the two sensing portions 31, 32 when the presser foot 11 moves to the start and end points of the travel to push the sliding element 50 and rotate the swing arm 40. Besides the metal sheet electrodes, the first sensing portion 31, the second sensing portion 32 and the induction portion 33 in the present embodiment can also be in the form of a photosensitive interrupt sensing element.

The fixing rack 20 is formed with a threaded hole 200 for locking a pivot shaft 21. The pivot shaft 21 is pivotally connected to the swing arm assembly B, so that the whole swing arm assembly B can pivot about the pivot shaft 21. The pivot shaft 21 includes a first end with an outer thread, a middle portion in the form of a cylinder, and a second end formed into a disk-shaped head. The middle portion of the pivot shaft 21 is bigger in outer diameter than the first end of the pivot shaft 21 but smaller in outer diameter than the second end of the pivot shaft 21.

The present invention is characterized in that:

The main body 40 of the swing arm assembly B is provided at a bottom thereof with a pivotal portion 41 in alignment with the threaded hole 200 of the fixing frame 20. The pivotal portion 41 is a rectangular frame and formed in a center thereof with a hollow rectangular horizontally-extending sliding groove 410. The pivotal portion 41 is formed in a side surface thereof with an adjusting threaded hole 411 in such a manner that an adjusting apparatus 60 can be screwed into the adjusting threaded hole 411 to perform the adjustment.

The pivotal portion 41 includes a first side 412, a second side 413, a top end 414 and a bottom end 415 that are connected together. The pivotal portion 41 is centrally further provided in each of the top end 414 and the bottom end 415 with a fixing threaded hole 416, 417 for insertion of the corresponding elements of the adjusting apparatus 60.

The adjusting apparatus 60 includes a sliding block 61 which is square-shaped in cross section allowed to slide relative to the sliding groove 410. The sliding block 61 is slidably disposed in the sliding groove 410 of the pivotal portion 41 in such a manner that its top and bottom end surfaces that are disposed in the sliding groove 410 abut against the top end 414 and the bottom end 415 of the pivot portion 41. The sliding block 61 is centrally formed with a pivot hole 610 for insertion of the pivot shaft 21. When the pivot shaft 21 is fixed in the threaded hole 200, the pivot hole 610 of the sliding block 61 is just mounted on the pivot shaft 21 in such a manner that the sliding block 61 can rotate on the pivot shaft 21.

The sliding block 61 is provided at an end exposed out of the sliding groove 410 with two opposite protruding ears 612 extending in an up and down direction, and each of the two opposite protruding ears 612 includes a horizontally-extending sliding slot 611. A fixing element 64 in the form of a bolt is inserted through each of the sliding slots 611 and screwed into each of the fixing threaded holes 416, 417, so that the sliding block 61 can be fixed by screwing the fixing elements 64 and released to slide horizontally in the sliding groove 410 by unscrewing the fixing elements 64.

Figure 3:
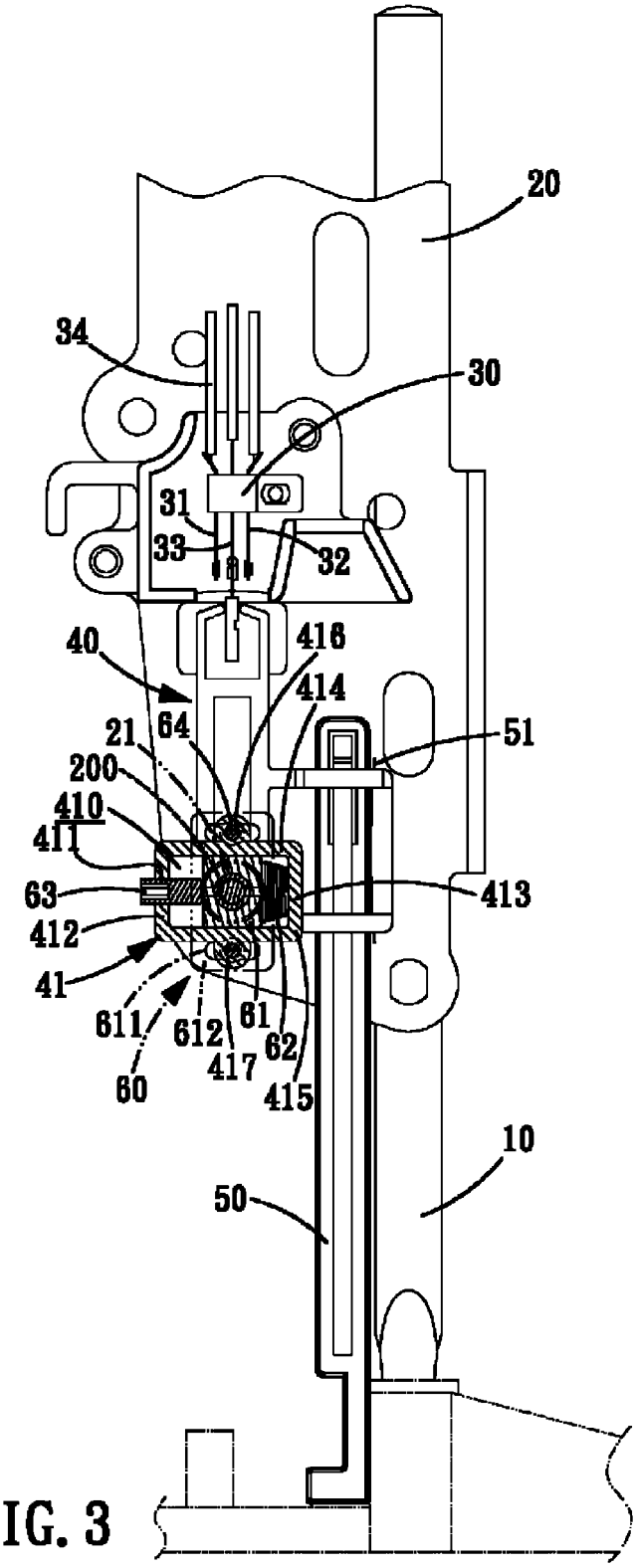
FIG. 3 is a planar assembly view of the sewing machine with an adjusting structure capable of controlling a swing center of a swing arm.

The adjusting apparatus 60 is further provided with an elastic element 62 in the form of a coil spring and an adjusting bolt 63. The elastic element 62 is disposed between the sliding groove 410 and the sliding block 61. In the present embodiment, the elastic element 62 is disposed in the sliding groove 410 and elastically presses against the second side 413 of the pivotal portion 41 and a first end surface of the sliding block 61. The adjusting bolt 63 is screwed in the adjusting threaded hole 411 in the first side 412 of the sliding groove 410 and inserted in the sliding groove 410 while pushing against a second end surface of the sliding block 61. Before adjustment, as shown in FIG. 3, the elastic element 62 which is elastically disposed between the sliding groove 410 and the sliding block 61 can provide an elastic prestress between the sliding block 61 and the adjusting bolt 63.

Figure 4:
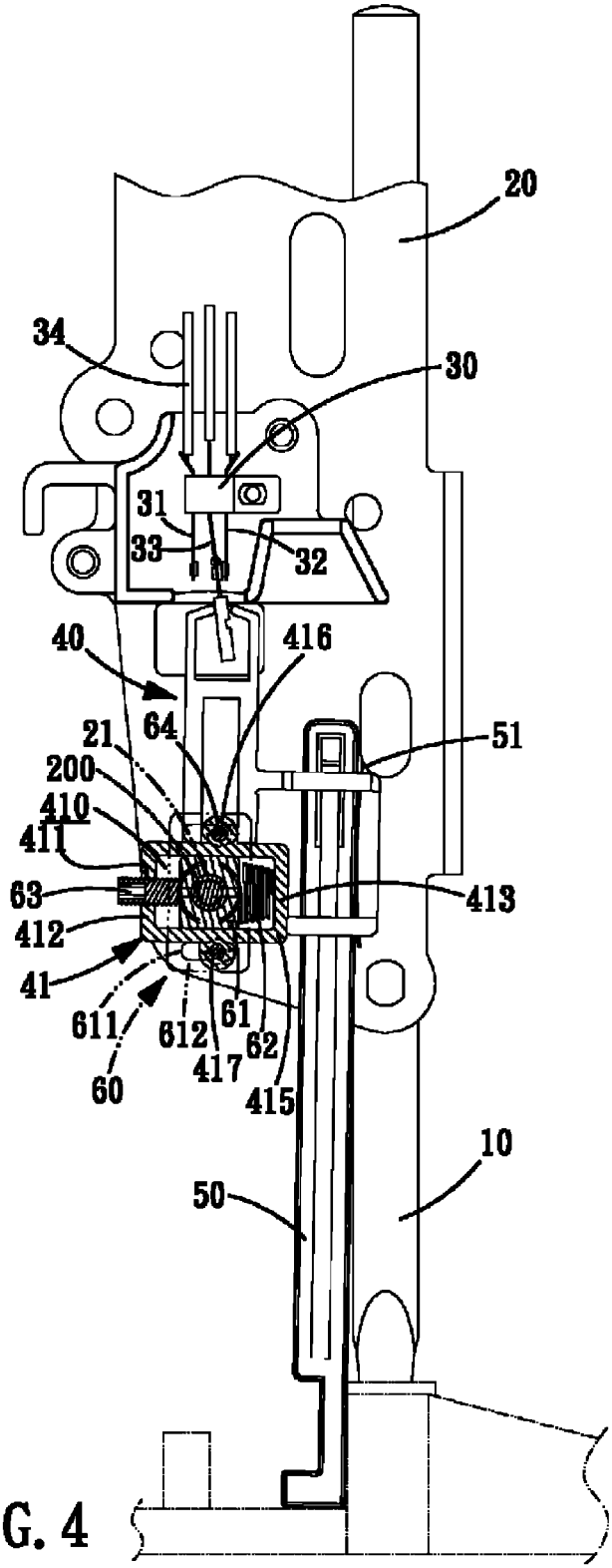
FIG. 4 is a planar operational view of FIG. 3.
Figure 5:
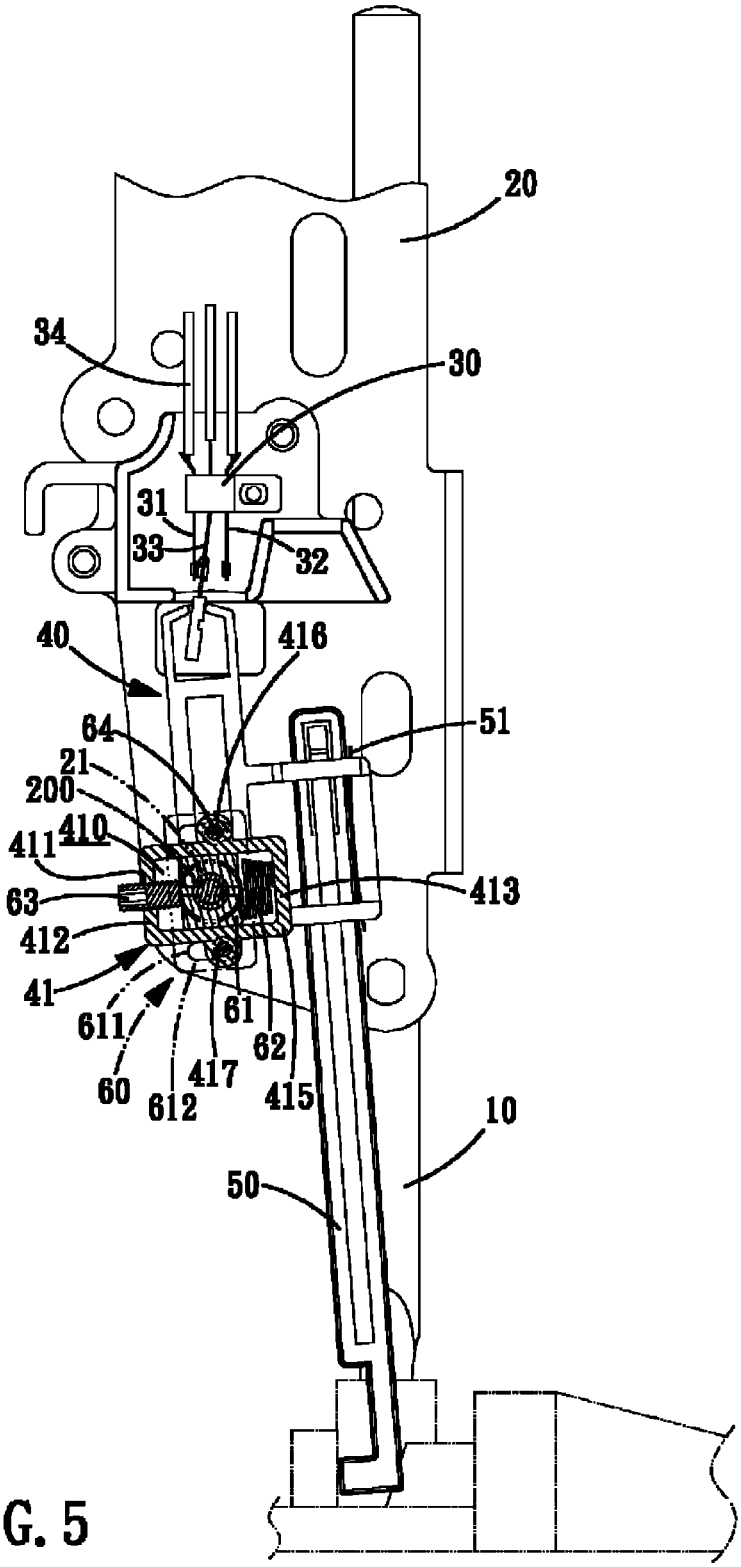
FIG. 5 is another planar operational view of FIG. 3

When in adjustment, the relative position of the main body 40 with respect to the sliding block 61 and the pivot shaft 21 which is the swinging center of the whole swing arm assembly B can be adjusted by rotating the adjusting bolt 63, so that the induction portion 33 connected to the main body 40 can be pre-adjusted to contact the first sensing portion 31 as shown in FIG. 4. When the presser foot 11 starts moving, the sliding element 50 and the main body 40 will be driven to rotate around the pivot shaft 21, and then the induction portion 33 will be moved to contact the second induction portion 33 to change a different travel. As shown in FIG. 5, in other words, when the induction portion 33 is brought into contact with the first sensing portion 31, the sewing machine in accordance with the present invention will sew the button hole along the first travel X1, and then when the induction portion 33 is brought into contact with the second sensing portion 32, the sewing machine in accordance with the present invention will sew the button hole along the second travel Y1 and then the third travel X2. After the induction portion 33 is brought into contact with the first sensing portion 31 again, the sewing machine in accordance with the present invention will sew the button hole along the fourth travel Y2.

With the above structures, the present invention can offer the following functions:

1. Micro-adjustment, quick and high accuracy: with rotation of the adjusting bolt 63 and the pushing of the elastic element 62, the relative position of the pivotal portion 41 of the main body 40 with respect to the sliding block 61 and the pivot shaft 21 can be quickly adjusted in such a manner that the main body 40 and the pivot shaft 21 only move horizontally relative to each other without causing height difference, so that when the presser foot 11 moves, the swing arm assembly B can accurately move the induction portion 33 to contact the first sensing portion 31 and the second sensing portion 32, ensuring high accuracy and quality of sewing of the button hole.

2. Stable overall structure: since the elastic element 62 is elastically disposed between the sliding groove 410 of the pivotal portion 41 of the main body 40 and the sliding block 61 of the pivot shaft 21, the swing arm assembly B, the pivot shaft 21 and the adjusting apparatus 60 can be assuredly positioned, offering a stable overall structure.

Figure 6:
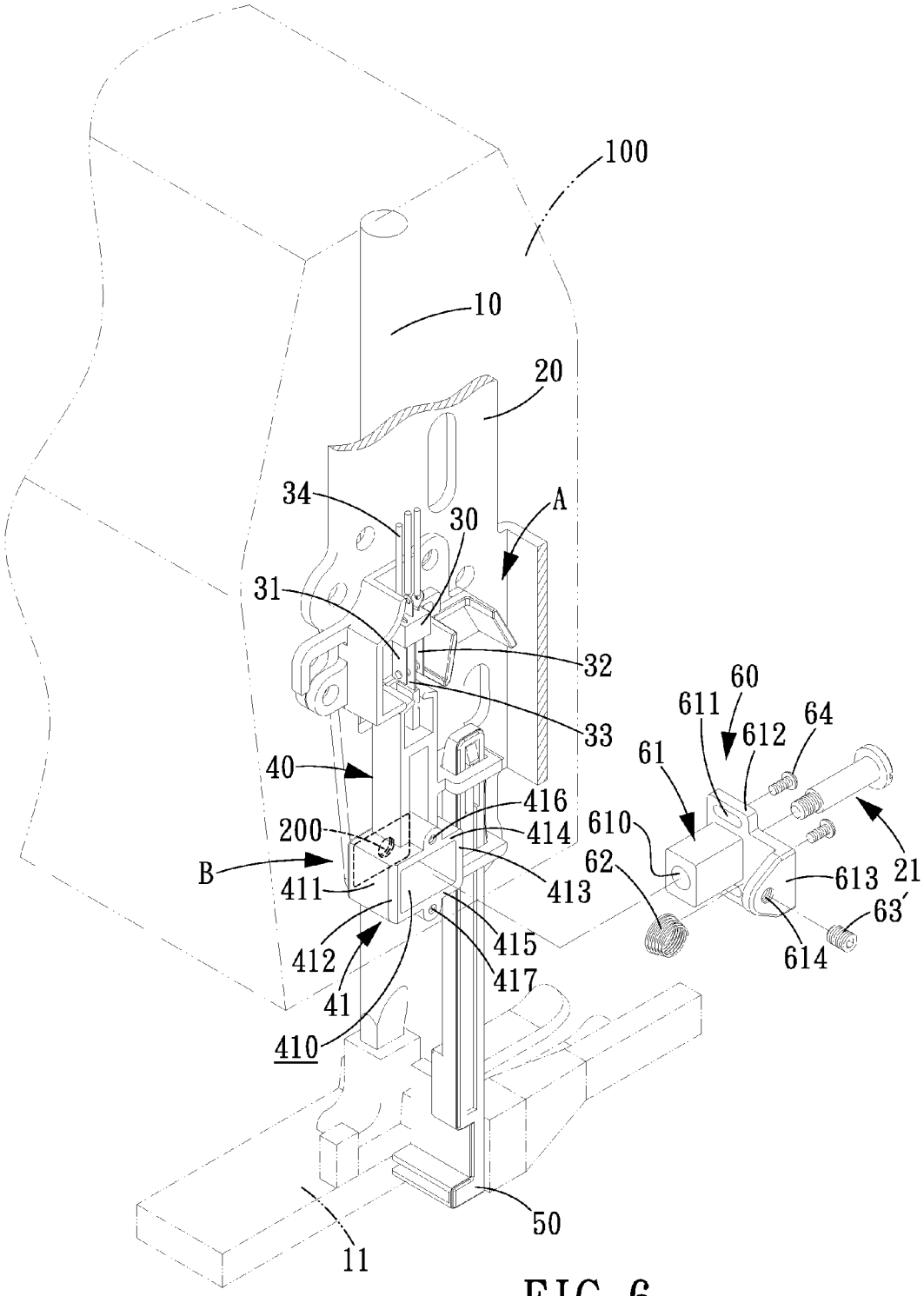
FIG. 6 is a partial exploded view of a sewing machine with an adjusting structure capable of controlling a swing center of a swing arm in accordance with a second embodiment of the present invention.
Figure 7:
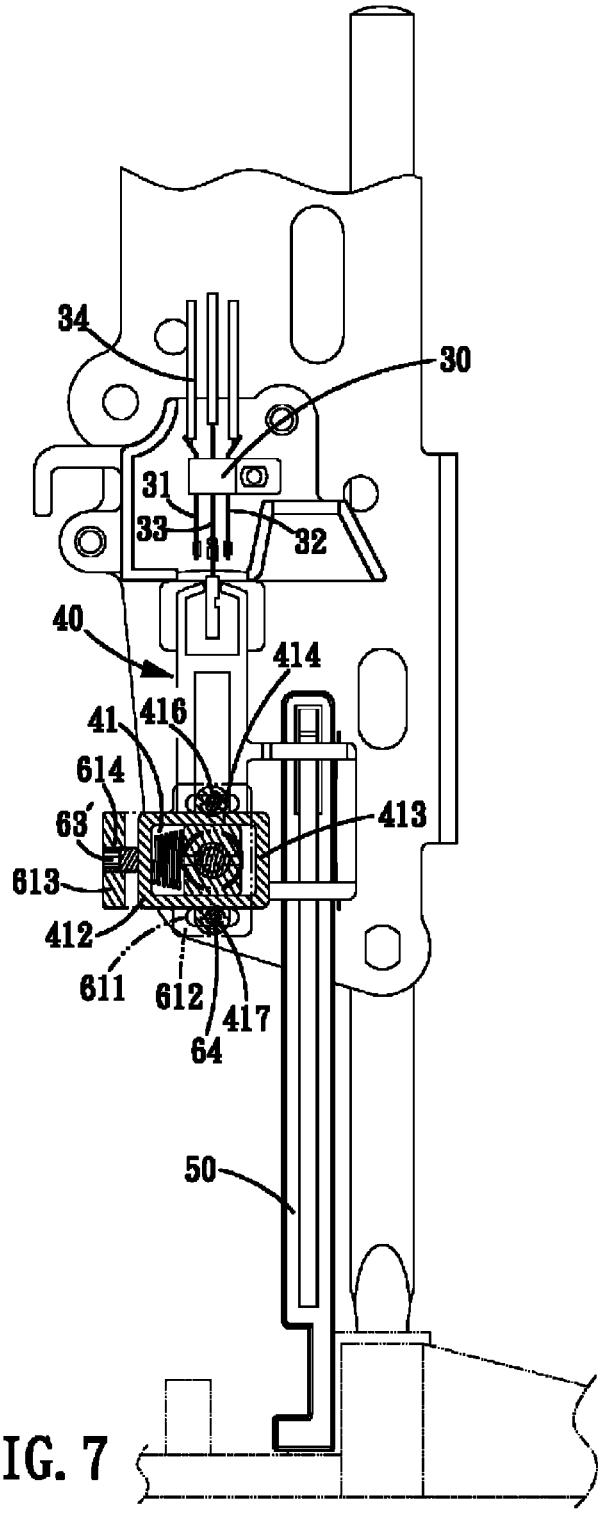
FIG. 7 is a planar assembly view of FIG. 6.

Referring to FIGS. 6 and 7 which show a sewing machine with an adjusting structure capable of controlling a swing center of a swing arm in accordance with a second embodiment of the present invention, besides the protruding ears 612, the sliding block 61 is further formed on the end exposed out of the sliding groove 41 with a laterally-extending L-shaped horizontally extending portion 613. The horizontally extending portion 613 covers an opening of the sliding groove 410 and includes a threaded hole 614 in an end thereof extending across the first side 412. An adjusting bolt 63' is screwed into the threaded hole 614 and pushes against the first side 412. An elastic element 62' in the present embodiment is disposed between the first side 412 and the sliding block 61 and can also offer the above function.

Figure 8:
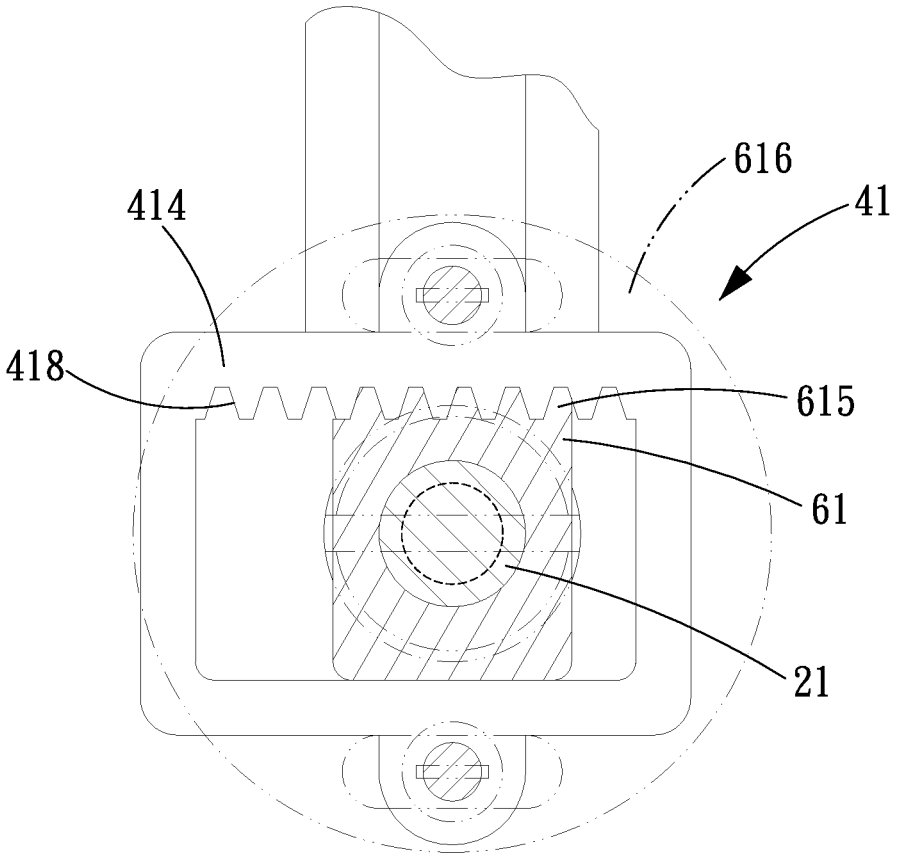
FIG. 8 is a planar assembly view of a sewing machine with an adjusting structure capable of controlling a swing center of a swing arm in accordance with a third embodiment of the present invention.

As shown in FIG. 8, the adjusting apparatus 60 can also be configured such that the sliding block 61 having an engaging portion 615 with continuous teeth is mounted on the pivot shaft 21, and the pivotal portion 41 is formed on an inner surface of the top end 43 with an engaging portion 413 to be engaged with the engaging portion 615 of the sliding block 61. The sliding block 61 is formed with a bigger disc-shaped head portion on an end thereof exposed out of the sliding groove 410, so that the user can pull the head portion 616 in the adjustment to make the sliding block 61 move away from the sliding groove 410 along the axial direction of the pivot shaft 21. After the pivotal portion 41 is moved to a proper position, the sliding block 61 will be re-installed on the pivot shaft 21 in the sliding groove 410, and the engaging portion 615 will be re-engaged with the engaging portion 413 of the sliding groove 410.

Figure 9:
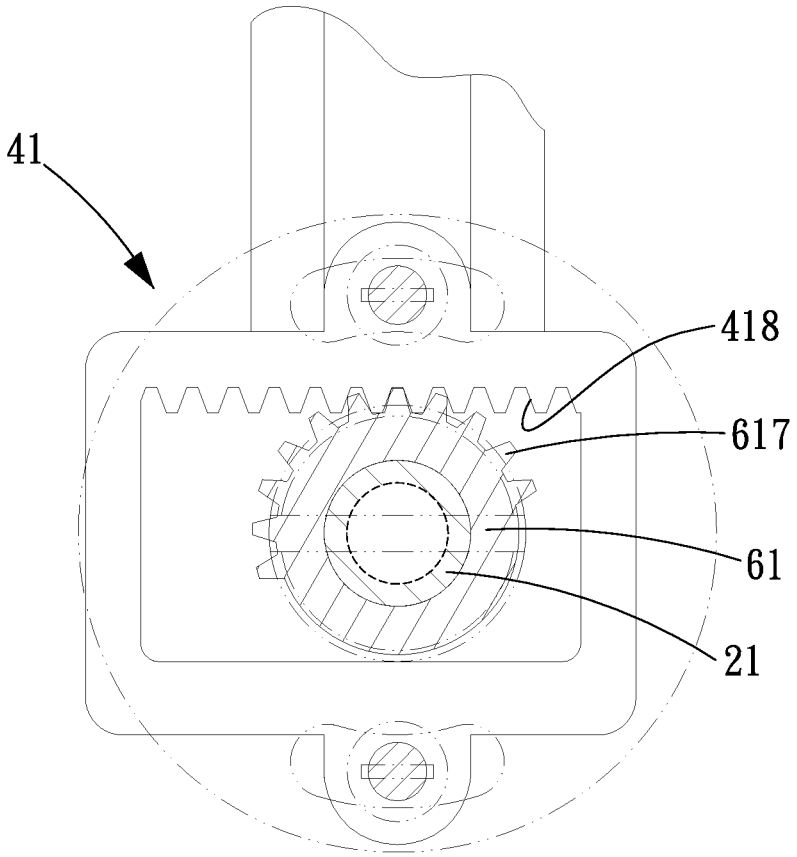
FIG. 9 is a planar assembly view a sewing machine with an adjusting structure capable of controlling a swing center of a swing arm in accordance with a fourth embodiment of the present invention.

As shown in FIG. 9, the sliding block 61 can also be in the form of a column and includes a sector engaging portion 617 to be engaged with the engaging portion 413 of the sliding groove 410 in the above embodiment. The pivotal portion 41 can be horizontally moved for adjustment by rotating the sliding block 61.

In the present invention, between the sliding element 50 and the main body 40 is additionally provided an arc elastic plate 51 for producing an elastic frictional force when the sliding element 50 is moved in the main body 40. The elastic plate 51 is disposed at one side of the bottom end of the main body 40 where the sliding element 50 is inserted, so that when the sliding element 50 is inserted in the main body 40, the elastic plate 51 will elastically push against the sliding element 50.

While we have shown and described various embodiments in accordance with the present invention, it is clear to those skilled in the art that further embodiments may be made without departing from the scope of the present invention.

What is claimed is:

1. A sewing machine with an adjusting structure capable of controlling swing center of a swing arm, the sewing machine including a suspension arm, the suspension arm being provided at a free end thereof with a presser foot shaft, and the presser foot shaft including a presser foot at a bottom thereof, in the suspension arm being disposed a travel sensing apparatus including a sensor and a swing arm assembly, the swing arm assembly including a main body for turning on/off the sensor and a sliding element having a first end slidably engaged in the main body, a second end of the sliding element extending toward the presser foot and being actuated when the presser foot moves to a start point and an end point of a travel;

a pivot shaft disposed in the suspension arm;

a pivotal portion being disposed on the main body of the suspension arm assembly; and an adjusting apparatus being provided on the pivotal portion with a sliding groove and a sliding block, and the sliding groove and the sliding block being allowed to horizontally slide with respect to each other.

2. The sewing machine with an adjusting structure capable of controlling swing center of the swing arm as claimed in claim 1, wherein the suspension arm is provided at the free end thereof with a fixing rack adjacent to the presser foot shaft, the fixing rack is formed by bending a plate-shaped element and provided with the travel sensing apparatus, the fixing rack is further formed with a threaded hole for locking the pivot shaft.

3. The sewing machine with an adjusting structure capable of controlling swing center of the swing arm as claimed in claim 1, wherein the pivot shaft includes a first end with an outer thread, a middle portion in the form of a cylinder, and a second end formed into a disk-shaped head, the middle portion of the pivot shaft is bigger in outer diameter than the first end of the pivot shaft but smaller in outer diameter than the second end of the pivot shaft.

4. The sewing machine with an adjusting structure capable of controlling swing center of the swing arm as claimed in claim 1, wherein the sensor includes a first sensing portion, a second sensing portion and an induction portion disposed between the first and the second sensing portions, each of the first sensing portion, the second sensing portion and the induction portion is connected to a computer through a wire, the induction portion is moved by the main body of the swing arm assembly in such a manner that when the presser foot moves to the start and the end points of the travel to push the sliding element and rotate the swing arm, the induction portion will move toward the first or the second sensing portions.

5. The sewing machine with an adjusting structure capable of controlling swing center of the swing arm as claimed in claim 1, wherein the first sensing portion, the second sensing portion and the induction portion each are in the form of a metal sheet electrode.

6. The sewing machine with an adjusting structure capable of controlling swing center of the swing arm as claimed in claim 1, wherein the sliding groove is a horizontally-extending hollow groove, the pivotal portion is formed in a side surface thereof with an adjusting threaded hole.

7. The sewing machine with an adjusting structure capable of controlling swing center of the swing arm and a swinging center that control travel of a sewing machine as claimed in claim 6, wherein the adjusting apparatus is further provided with an adjusting bolt and an elastic element, the adjusting bolt is screwed in the adjusting threaded hole in the side surface of the sliding groove and pushes against the sliding block, the elastic element is disposed between the sliding groove and the sliding block.

8. The sewing machine with an adjusting structure capable of controlling swing center of the swing arm as claimed in claim 1, wherein the pivotal portion is centrally formed in each of a top end and a bottom end thereof with a fixing threaded hole for insertion of corresponding elements of the adjusting apparatus.

9. The sewing machine with an adjusting structure capable of controlling swing center of the swing arm as claimed in claim 1, wherein the sliding block is square-shaped in cross section and slidably disposed in the sliding groove of the pivotal portion in such a manner that its top and bottom end surfaces that are disposed in the sliding groove abuts against a top end and a bottom end of the pivotal portion, the sliding block is formed with a pivot hole for insertion of the pivot shaft, the pivot shaft is fixed in the suspension arm, the pivot hole of the sliding block is mounted on the pivot shaft;

the sliding block is provided at an end thereof exposed out of the sliding groove with two opposite ears, each of the two opposite protruding ears includes a horizontally-extending sliding slot, a fixing element in the form of a bolt is inserted through each of the sliding slots and screwed into each of the fixing threaded holes.

10. The sewing machine with an adjusting structure capable of controlling swing center of the swing arm as claimed in claim 8, wherein the sliding block is in the form of a square cylinder and slidably disposed in the sliding groove of the pivotal portion in such a manner that its top and bottom end surfaces that are disposed in the sliding groove abuts against a top end and a bottom end of the pivotal portion, the sliding block is formed with a pivot hole for insertion of the pivot shaft, the pivot shaft is fixed in the suspension arm, the pivot hole of the sliding block is mounted on the pivot shaft;

the sliding block is provided at an end thereof exposed out of the sliding groove with two opposite ears, each of the two opposite protruding ears includes a horizontally-extending sliding slot, a fixing element in the form of a bolt is inserted through each of the sliding slots and screwed into each of the fixing threaded holes.

11. The sewing machine with an adjusting structure capable of controlling swing center of the swing arm as claimed in claim 1, wherein the elastic element of the adjusting apparatus is in the form of a coil spring, the pivotal portion includes a first side, a second side, a top end and a bottom end that are connected together, the elastic element is disposed in the sliding groove and elastically presses against the second side of the pivotal portion1 and a first end surface of the sliding block, the adjusting bolt is screwed in the adjusting hole in the first side of the sliding groove and inserted in the sliding groove while pushing against a second end surface of the sliding block.

12. The sewing machine with an adjusting structure capable of controlling swing center of the swing arm as claimed in claim 1, wherein the sliding block is further formed on the end thereof exposed out of the sliding groove with a laterally-extending horizontally extending portion, the horizontally extending portion includes a threaded hole, an adjusting bolt is screwed into the threaded hole of the extending portion and pushes against a side of the pivotal portion, an elastic element is disposed between the side of the pivot portion and the sliding block.

13. The sewing machine with an adjusting structure capable of controlling swing center of the swing arm as claimed in claim 1, wherein the sliding block mounted on the pivot shaft includes an engaging portion with continuous teeth, the pivotal portion is formed on an inner surface opposite the sliding block with an engaging portion to be engaged with the engaging portion of the sliding block, the sliding block is formed with a bigger disc-shaped head portion on an end thereof exposed out of the sliding groove.

14. The sewing machine with an adjusting structure capable of controlling swing center of the swing arm as claimed in claim 13, wherein the sliding block is in the form of a column and includes a sector engaging portion to be engaged with the engaging portion of the sliding groove.

* * * * *